US009581402B2

(12) United States Patent
Minnicino, II

(10) Patent No.: US 9,581,402 B2
(45) Date of Patent: Feb. 28, 2017

(54) PROJECTILE FOR USE WITH A TAPERED BORE GUN

(71) Applicant: U.S. Army Research Laboratory ATTN: RDRL-LOC-I, Washington, DC (US)

(72) Inventor: Michael A. Minnicino, II, Baltimore, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 19 days.

(21) Appl. No.: 14/295,642

(22) Filed: Jun. 4, 2014

(65) Prior Publication Data

US 2015/0354929 A1 Dec. 10, 2015

(51) Int. Cl.
*F42B 30/02* (2006.01)
*F41A 21/16* (2006.01)

(52) U.S. Cl.
CPC ..... *F41A 21/16* (2013.01); *F42B 30/02* (2013.01)

(58) Field of Classification Search
CPC ..... F42B 10/48; F42B 10/24; F42B 12/02; F42B 12/24; F42B 30/02
USPC ..... 102/501–508, 511–528
See application file for complete search history.

(56) References Cited

U.S. PATENT DOCUMENTS

| | | | | |
|---|---|---|---|---|
| 2,549,832 | A * | 4/1951 | Mackta | 42/78 |
| 5,058,503 | A * | 10/1991 | Adams, III | 102/501 |
| 5,164,538 | A * | 11/1992 | McClain, III | 102/517 |
| 6,629,669 | B2 * | 10/2003 | Jensen | 244/3.23 |
| 8,893,621 | B1 * | 11/2014 | Escobar | 102/503 |
| 2005/0000385 | A1 * | 1/2005 | Booth | 102/514 |
| 2006/0096491 | A1 * | 5/2006 | Fichot et al. | 102/501 |
| 2007/0074637 | A1 * | 4/2007 | Pontieri | 102/501 |
| 2012/0180690 | A1 * | 7/2012 | Masinelli et al. | 102/514 |
| 2012/0199035 | A1 * | 8/2012 | Frank | 102/506 |

* cited by examiner

*Primary Examiner* — Joshua Freeman
(74) *Attorney, Agent, or Firm* — Alan I. Kalb

(57) ABSTRACT

A projectile for use with a tapered gun bore having a tapered bore section between the breech and the muzzle. The projectile includes an elongated body having a cylindrical bulkhead with a diameter substantially equal to the large caliber section of the gun bore. A tapered ogive extends from the bulkhead to a front end of the projectile while a tapered tail extends from a rear end of the projectile to the cylindrical bulkhead. A plurality of circumferentially spaced forward grooves extend forwardly from the bulkhead and to a point short of the front end while a plurality of circumferentially spaced rearward grooves extend rearwardly from said midsection and to a point short of a rear end of the body.

4 Claims, 1 Drawing Sheet

PROJECTILE FOR USE WITH A TAPERED BORE GUN

GOVERNMENT INTEREST

The invention described herein may be manufactured, used, and licensed by or for the United States Government.

BACKGROUND OF THE INVENTION

I. Field of the Invention

The present invention relates generally to munitions and, more particularly, to a projectile for use with a tapered bore gun.

II. Description of Relevant Art

Guns having a tapered bore barrel have been used in combat since WWII and their popularity has waxed and waned since that time primarily because projectiles designed to be tired from these guns often exhibited compliant flanges that proved to have marginal structural integrity due to significant deformation while traversing the tapered section of the gun as well as unreliable aerodynamic stability due to the projectile's flanges inability to adequately engage with the rifling resulting in inconsistent gyroscopic stabilization. Modern tapered bore gun typically include a first constant diameter bore extending from the firing chamber of the bore to an intermediate point of the gun barrel and a smaller caliber bore extending a short distance from a front end of the barrel. A tapered bore section then connects the larger diameter first bore with the smaller diameter second bore. Alternatively, the tapered bore may extend continuously from the chamber to adjacent the muzzle. Rifling is present in the initial bore section of the tapered bore gun to impart spin to the projectile about its longitudinal axis. The spin acts to gyroscopically stabilize the projectile, improving its aerodynamic stability during flight.

When a projectile is fired from the tapered bore gun, the larger, initial caliber bore of the gun barrel provides for enhanced acceleration of the projectile during gun launch which results in a higher muzzle exit velocity compared to a constant diameter gun of the same caliber as the tapered gun's emergent caliber. The projectile is compressed radially inward by the tapered bore to a smaller diameter that is more aerodynamic due to its smaller frontal area and more streamlined geometry enabling the projectile to achieve greater velocities at extended ranges. However, as the projectile is radially compressed, it elongates due to the metallic projectile material being incompressible, i.e. the volume of the projectile is conserved, as it plastically deforms. However, the ability of a projectile to be gyroscopically stabilized decreases with increasing projectile length. Therefore, the radial compression of the projectile by the tapered bore must be such that it the emergent-geometry projectile is aerodynamically stable during flight.

SUMMARY OF THE PRESENT INVENTION

The present invention provides a projectile for use with a tapered bore gun which overcomes the above mentioned disadvantages of the previously known projectiles.

In brief, the projectile of the present invention comprises an elongated body having a cylindrical bulkhead with a diameter substantially the same or slightly greater than the large caliber section of the gun bore. A roundly tapered ogive then extends from the cylindrical bulkhead and to a front end of the projectile. A tapered tail section extends from the cylindrical bulkhead to a rear end of the projectile.

A plurality of circumferentially spaced and axially oriented grooves extend forward from the cylindrical bulkhead and to a point short of the front end. These grooves comprise the set of forward grooves. Similarly, a plurality of circumferentially spaced and axially oriented grooves extend rearward from the cylindrical bulkhead and to a point short of the rear end of the projectile. These grooves comprise the set of rearward grooves. The projectile also preferably includes a cylindrical bore which extends from the rear end of the projectile and to a point between the front end of the projectile and the cylindrical bulkhead.

Upon firing, the cylindrical bulkhead obturates the high-pressure launch gases. When the projectile passes through the tapered section of the pin bore, the gun bore radially inwardly compresses the projectile. Consequently, as the projectile passes through the small caliber section of the gun bore and exits the muzzle, the projectile is cylindrical in shape.

The use of the grooves and the axially extending bore operate to perform a number of beneficial functions. The grooves and the axial bore result in the projectile being more easily compressible in the radial direction yet sufficiently stiff and strong in the axial direction. This results in reduced energy losses due to plastic deformation and frictional effects as the projectile traverses the tapered bore section of the gun leading to improved acceleration and muzzle velocity compared to a projectile without the grooves or the bore. Additionally, the grooves and the axial bore reduce the volume of material that is compressed and provide a void for it to deform into, respectively. Consequently, the emergent-geometry projectile has a greater margin of aerodynamically stability because it does not grow in length nearly as much as a projectile without grooves or without a bore. Additionally, if the projectile is designed such that the axial bore surface terminates forward of the projectile bulkhead, the pressure acting on the bore's axial surface will necessarily be a restoring force and will act to reduce projectile balloting and improve accuracy. Lastly, the reduced diameter, emergent-geometry projectile is a aerodynamic, low-drag, high sectional density projectile that is able to be gyroscopically stabilized by the gun's rifling.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
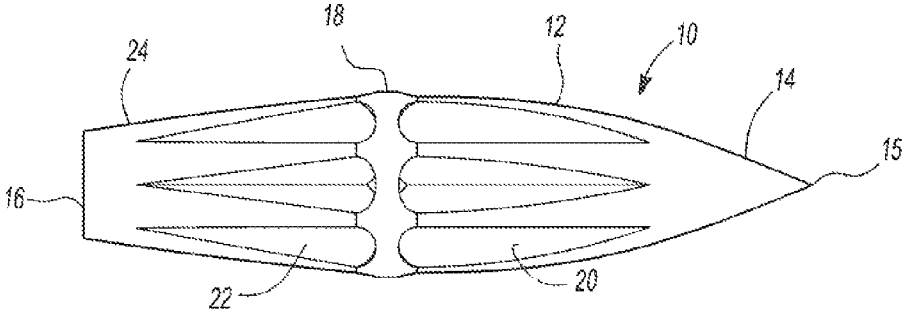
FIG. 1 is a side view illustrating a preferred embodiment of the projectile of the present invention.

With reference to FIGS. 1-4, a preferred embodiment of a projectile 10 according to the present invention is shown for use with a tapered bore gun. Such tapered bore guns include a tapered bore section which reduces in diameter or caliber from the breech end of the bore and the muzzle.

The projectile 10 includes an elongated body 12 having a curved surface ogive 14 that is forwardly adjacent to the bulkhead 18 and terminates at a point 15 forward of the elongated body 12. The projectile 10 has a rear tapered section 24 located rearwardly adjacent to the bulkhead 18 and ends at the rear end 16. The body 12 is made of a malleable material such as brass and/or copper or alloys thereof.

A cylindrical bulkhead 18 of the body 12 has a diameter substantially the same, or slightly greater, than the caliber of the first or larger caliber section of the tapered gun bore. Consequently, when the projectile 10 is loaded into the chamber end of the gun bore, the cylindrical bulkhead 18 of the projectile 10 obturates the launch gases for maximum acceleration.

A plurality of axially oriented and circumferentially spaced forward grooves 20 extend forwardly from the cylindrical bulkhead 18 of the body 12 and towards a forward end 15 of the body 12 and thus along the ogive 14. These grooves 20, however, terminate short of the forward end 15 of the body 12.

Similarly, another plurality of axially oriented and circumferentially spaced rearward grooves 22 extend rearwardly from the central bulkhead 18 and toward the rear end 16 of the body 12. These grooves 22, furthermore, terminate short of the rear end 16 of the body 12 so that a tail end 24 of the body 12 is free of rearward grooves 22. Furthermore, the un-grooved portion of the rear taper section 24 of the body 12 tapers radially inwardly for a reason to be subsequently described.

Figure 3:
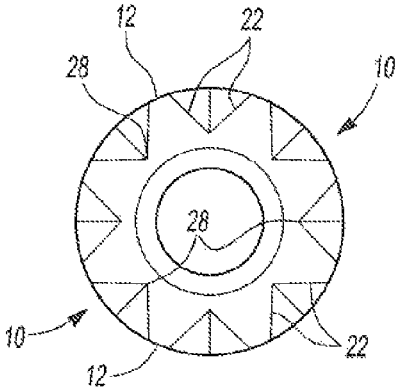
FIG. 3 is a rear view of the projectile.
Figure 4:
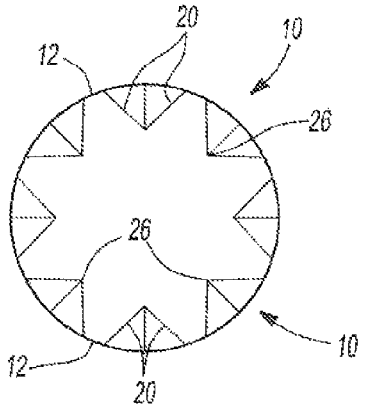
FIG. 4 is a front view.

As best shown in FIGS. 3 and 4, each of the forward grooves 20 and rearward 22 have a cross-sectional area that is generally triangular in shape. The two straight sides of the triangular shaped groove intersect at a point which corresponds to the groove minor diameter. The forward grooves 20 have a groove minor diameter 26 and the and rearward grooves 22 have a groove minor diameter 28, and in this embodiment, the forward and rearward grooves have equivalent groove minor diameters. In addition, the groove minor diameters 26 and 28 are the distance between diametrically opposed grooves which are substantially equal to or slightly less than the caliber or diameter of the second or smaller caliber bore of the gun.

Figure 2:
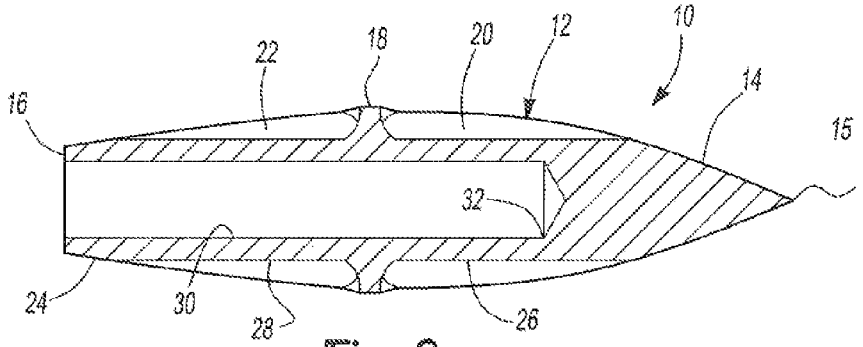
FIG. 2 is a longitudinal sectional view of the projectile of the present invention.

As best shown in FIG. 2, an elongated axially extending bore 30 extends from the rear end 16 to a point 32 forwardly of the cylindrical bulkhead 18 of the body 12.

The body 12 is preferably a one piece construction and constructed of a ductile material, such as brass, copper, alloys thereof, and/or the like.

Figure 5:
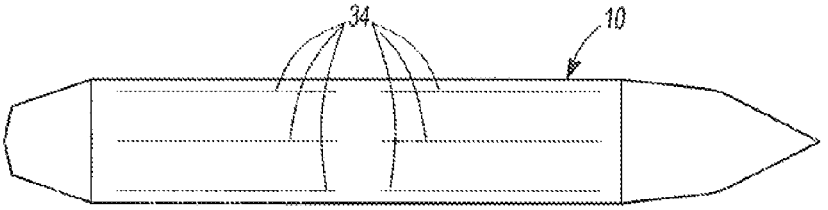
FIG. 5 is a side view of the projectile during exit of the projectile from the muzzle.

In operation, upon firing, the projectile 10 initially travels through the initial bore section of the gun bore. As the projectile 10 travels through the tapered section of the gun bore, the gun bore compresses the projectile radially inward which simultaneously elongates the projectile to the shape illustrated in FIG. 5. Consequently, the projectile 10 is generally elongated and cylindrical in shape upon exit from the muzzle but retains the inwardly tapered section 24 at the rear end of the projectile. This inwardly tapered section 24 often denoted as the projectile's boat tail improves the aerodynamic characteristics of the projectile and reduces aerodynamic drag during flight. Further, the grooves are compressed to the extent that the compressed grooves 34 appear as lines in the emergent-geometry projectile.

The forward grooves 20 and the rearward 22 on the projectile body 12 achieve several advantages over the previously known ungrooved projectiles for tapered bore guns. The grooves 20 and 22 reduce the material volume of the projectile 10 that is radially compressed while traversing the tapered section of the gun bore. Due to this reduced volume, the projectile 10 undergoes less elongation than the previously known projectiles without the grooves.

In addition, because the grooves 20 and 22 reduce the volume of compressed material, the contact pressure between the projectile and the gun bore is significantly less as the projectile travels through the tapered bore section of the gun bore. This, in turn, results in less frictional losses for the projectile and therefore greater projectile muzzle velocity.

The grooves 20 and 22 also provide sufficient projectile material to engage the rifling in order to reliably provide spin for the purpose of gyroscopically stabilizing the projectile during flight.

The inwardly tapered section 24 creates a "boat tail". This boat tail reduces the aerodynamic drag of the projectile 10 after muzzle exit for increased accuracy.

In addition, the bore 30 in the projectile body 12 achieves several advantages. First, the bore 30 increases the case of compression of the overall projectile as it travels through the tapered bore section of the gun bore thus reducing friction forces between the projectile 10 and the gun barrel thereby enabling greater muzzle velocity. In addition, since the gases during launch act on the entire inner surface of the bore 30 as well as the exterior surfaces of the rear tapered section 24, the pressure acting on the inner surface of the bore 30 prevents deformation of the projectile body during the initial launch. Lastly, the bore 30 terminates forward of the bulkhead 18 which, when acted upon by the high-pressure gases during gun launch, also helps maintain the body 12 axially aligned with the gun bore.

Having described my invention, many modifications will become apparent to those skilled in the art to which it pertains without deviation from the spirit of the invention as defined by the scope of the appended claims.

I claim:

1. A projectile for use with a tapered gun bore having a large caliber section, a small caliber section and a tapered section connecting said large and small caliber sections together, the projectile comprising:

an elongated body having a cylindrical bulkhead with a diameter substantially equal to the large caliber section of the gun bore, a cylindrical midsection located proximate to said cylindrical bulkhead, said body having a tapered nose extending from said cylindrical bulkhead to a front end of said projectile and a tapered tail extending from a rear end of the projectile to said cylindrical midsection, a plurality of axially oriented and circumferentially spaced forward grooves extending forwardly from said bulkhead and to a point short of said front end comprising the forward grooves, a plurality of axially oriented and circumferentially spaced rearward grooves extending rearwardly from said bulkhead comprising the rearward grooves, said body being formed of a compressible material including but not limited to, copper, lead, aluminum, and steel, whereby when the projectile is fired through a tapered bore gun the body of the projectile is uniformly compressed in a controlled uniform radial pattern that affects the entire the projectile equally thus allowing for extreme velocities while maintaining accuracy.

2. The projectile as defined in claim 1 wherein said rearward grooves taper in both surface angle and depth before terminating in a single point near said rear end of said body.

3. The projectile as defined in claim 2 wherein said rearward grooves are at least twice as long axially as they are wide radially.

4. The projectile as defined in claim 1 wherein said body includes a cavity which extends from said rear end of said body at least three quarters the length of said body and said cavity having a diameter and that diameter being at least half that of the overall diameter of said body.

* * * * *